US005179893A

United States Patent [19]

Richardson

[11] Patent Number: 5,179,893

[45] Date of Patent: Jan. 19, 1993

[54] CAN CRUSHING AND STORAGE UNIT

[75] Inventor: Larry V. Richardson, Riverside, Calif.

[73] Assignee: Kantech Industries, Inc., Irvine, Calif.

[21] Appl. No.: 760,618

[22] Filed: Sep. 16, 1991

Related U.S. Application Data

[63] Continuation-in-part of Ser. No. 650,661, Feb. 5, 1991.

[51] Int. Cl.[5] ..... B30B 9/32; B30B 1/02

[52] U.S. Cl. ..... 100/98 R; 100/227; 100/245; 100/293; 100/902

[58] Field of Search ..... 100/35, 41, 98 R, 218, 100/226-228, 240, 245, 283, 293, 902

[56] References Cited

U.S. PATENT DOCUMENTS

| | | | |
|---|---|---|---|
| 2,603,270 | 7/1952 | Voigt et al. | 100/293 X |
| 2,603,271 | 7/1952 | Heymers | 100/902 X |
| 2,638,957 | 5/1953 | Danielson | 100/902 X |
| 2,813,569 | 11/1957 | Nelson | 100/902 X |
| 3,055,289 | 9/1962 | Komph, Sr. | 100/240 X |
| 3,104,607 | 9/1963 | Galas | 100/902 X |
| 3,411,722 | 11/1968 | Webber | 100/245 X |
| 3,768,398 | 10/1973 | Ullman, Jr. | 100/218 X |
| 4,062,283 | 12/1977 | Kaminski | 100/902 X |
| 4,213,387 | 7/1980 | McCaney et al. | 100/902 X |
| 4,240,341 | 12/1980 | Whipple et al. | 100/902 X |
| 4,248,144 | 2/1981 | Morgan | 100/902 X |
| 4,301,722 | 11/1981 | Balbo et al. | 100/902 X |
| 4,345,520 | 8/1982 | Goldsmith et al. | 100/902 X |

OTHER PUBLICATIONS

One sheet, two photographs of a device manufactured by Pacific Fabrication, Inc. No date.

*Primary Examiner*—Harvey C. Hornsby
*Assistant Examiner*—Stephen F. Gerrity
*Attorney, Agent, or Firm*—Knobbe, Martens, Olson & Bear

[57] ABSTRACT

A device for crushing aluminum cans has a lid that can be engaged with a receptacle, and an aperture through which crushed cans can drop is formed in the lid. A housing is mounted on the lid, and the housing forms a channel. The housing has a closed surface positioned against the lid, an open side opposite the closed surface, and a closed end. An opening is formed through the closed surface and is juxtaposed with the aperture of the lid. A crushing plate is reciprocally disposed in the channel and can be moved toward the closed end of the aperture. When a can is to be crushed, it is laid on its side in the channel, and the plate is moved to axially compress the can against the closed end of the housing. When the can has been sufficiently compressed, it drops through the opening into the receptacle.

5 Claims, 1 Drawing Sheet

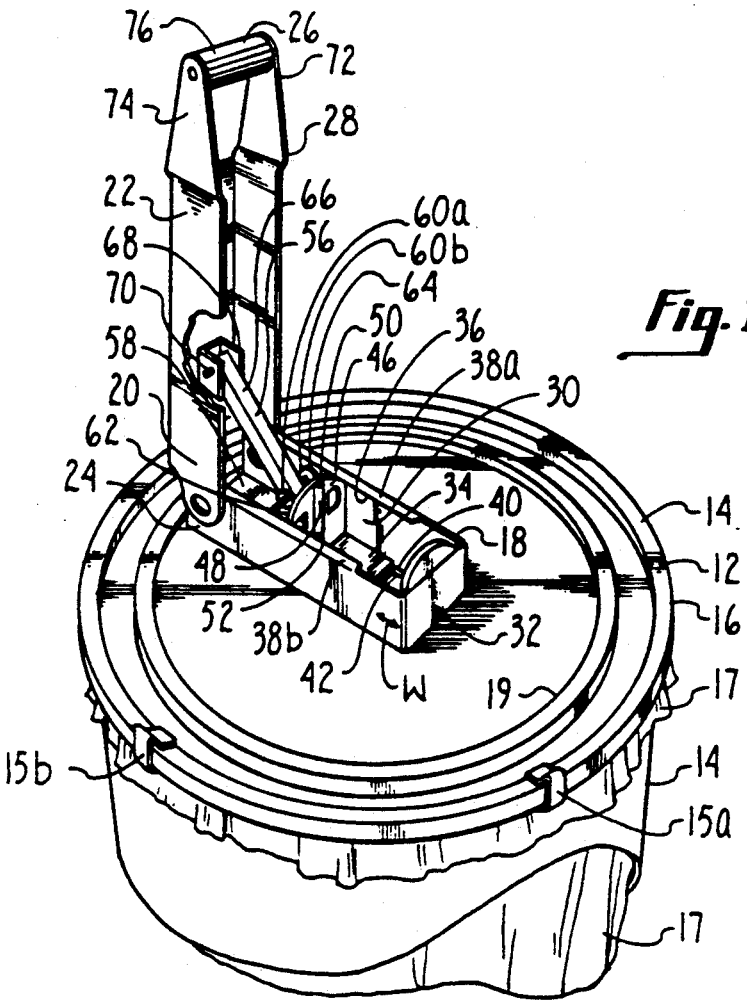
Fig. 1
Fig. 2
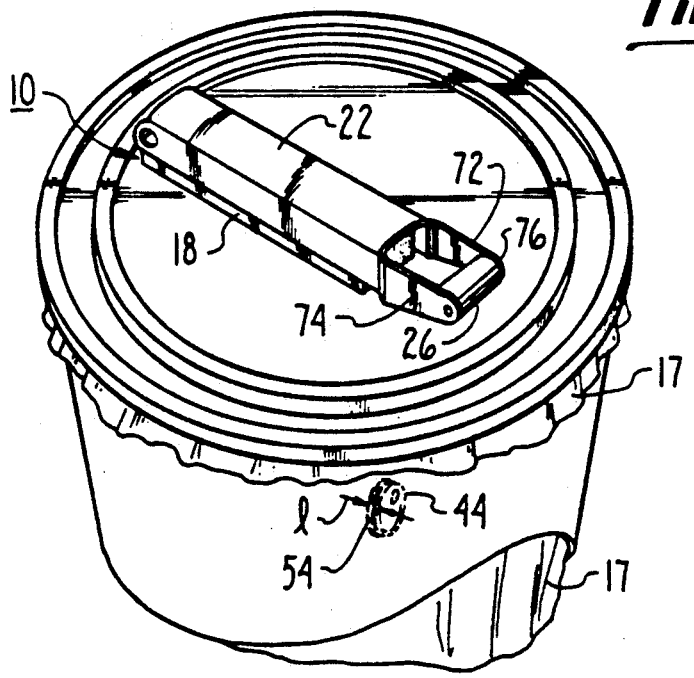

CAN CRUSHING AND STORAGE UNIT

RELATED APPLICATIONS

This application is a continuation-in-part of U.S. Design patent application Ser. No. 07/650,661, filed Feb. 5, 1991, entitled "CAN CRUSHING UNIT," which is hereby incorporated herein by reference.

FIELD OF THE INVENTION

The present invention relates generally to aluminum recycling devices, and more particularly to devices for recycling aluminum cans.

BACKGROUND

The earth's natural resources are being depleted at an alarming rate. As an example, aluminum is one resource which is being rapidly depleted for a wide variety of human uses. One of the applications for which aluminum is used is as a bulk material in metal alloys for making aircraft, motor vehicles, and large components that can be assembled for constructing dwellings. Another application which requires the mining and processing of a significantly large amount of aluminum is the manufacturing of containers, i.e., aluminum cans, that hold beverages for human consumption.

Aluminum mining, besides depleting the earth's aluminum ore, can result in harm to the environment. Specifically, certain types of aluminum mining, like most kinds of ore mining, can result in damage to the land being mined by making the land unsightly and unfit for many kinds of animal and plant life for an extended period subsequent to the mining. Further, the processing of the raw aluminum into usable alloys can pollute the earth's atmosphere.

Moreover, used aluminum products, such as used beverage cans, are often disposed of in landfills. These aluminum products do not rapidly decay, but remain a near-permanent part of the landfills long after the landfills are no longer used for garbage disposal. Also, land which can otherwise be used as a waste disposal site is becoming increasingly more valuable for other uses, such as housing. Accordingly, it is desirable to reuse aluminum products whenever possible, to avoid both excessive mining and processing of raw aluminum, and to avoid exhausting landfills with aluminum waste.

For the reasons above, the necessity for recycling aluminum cans has taken on new urgency. Recycling efforts, however, can be inconvenient, particularly for the users of the aluminum cans. More particularly, it is easier for the typical consumer to simply throw away an aluminum can after use, rather than to deposit the can in a receptacle which is dedicated to the storing of used cans, and then transporting the somewhat bulky cans to a recycling facility.

To make the cans easier to transport, a number of devices have been developed to assist consumers in crushing the cans. One such device is made by Pacific Fabrication, Inc. of Rancho Cucamonga, Calif. and is sold under the trademark "Can Crusher." The "Can Crusher" consists of a wall-mounted housing which has a plunger reciprocally disposed in the housing. A lever arm is pivotally attached to the plunger and housing, and can be manually pulled downward to force the plunger against a can which has been placed in the housing to crush the can.

The "Can Crusher" is obviously capable of condensing cans, and has gained a level of acceptance among a segment of aluminum can consumers. In the area of recycling, however, the issue is rarely one of capacity, but is usually one of convenience. That is, experience has shown that whether an average consumer will begin to recycle is largely dependent on the initial level of cost and effort required to begin recycling. Over an extended period of time, however, whether the average consumer will recycle is largely determined by the convenience and the satisfaction the consumer derives from his or her recycling efforts.

In this regard, the "Can Crusher" has a number of drawbacks. First, for some, the "Can Crusher" demands a significant amount of physical exertion to operate. Second, the "Can Crusher" is wall-mounted, requiring that the user exert significant initial effort in embedding fasteners into the wall to hold the device against the wall. The realization that, once mounted, the "Can Crusher" cannot easily be removed or relocated may deter a consumer whose level of commitment to recycling is not substantial from giving recycling a try. Similarly, for those people renting their place of residence, the realization that the "Can Crusher" can leave unsightly marks and holes on the wall after the unit is removed may likewise deter its use. Further, once crushed, the aluminum cans must be manually removed from the device. This can be both messy and dangerous. Specifically, fluid from the can will often escape from cracks in the crushed can and drip on the user and the wall and floor below the unit. Likewise, there is a significant risk that the user will be cut by a jagged metal edge of a crushed can while removing the can from the unit.

For these and other reasons, there is needed an improved can recycling device which lowers the initial barriers to beginning recycling, while at the same time enhancing the convenience and satisfaction derived from the consumer using the unit.

SUMMARY

The present invention provides a safe, inexpensive and convenient can crushing and storage unit, that not only makes recycling easier, but also enjoyable. The unit includes a can crusher with a housing defining a space sized and shaped to receive a standard sized aluminum can so that its longitudinal axis is substantially horizontal The crusher is mounted on a lid which is secured to a receptacle, both of which form a portion of the unit. The crusher includes a plunger for crushing a can positioned within the space until it is sufficiently axially compacted that gravity causes the can to fall through a passage in the crusher housing and lid into the receptacle. Desirably, the passage is generally vertically aligned with the center of gravity of the unit so that the moment arm of the force exerted on the can by the plunger will be minimized.

Unexpectedly, it has been found that by providing a can crusher in which cans are crushed along their longitudinal axis until their axial length is less than the width of the opening so that gravity causes the crushed can to fall through the opening and land with a reassuring "click," the consumer's satisfaction in recycling cans is greatly enhanced. Experience has shown that individuals using the device for the first time will often go out and collect cans from others so that they can be crushed and stored in the unit. Whether the consumer's satisfaction is derived from the enhanced convenience of having the crushed can fall directly into the receptacle rather than comprising a dripping mess for the user to handle or from the same source of pleasure a child finds in banging shaped pegs through holes in the nursery, is not known. However, for whatever reason, this enhanced satisfaction in recycling will hopefully translate into more cans being recycled and an improved environment for us all.

Another aspect of the present invention is a can crusher including a lid shaped to engage a receptacle, e.g., a standard thirty two (32) gallon plastic garbage can. The lid and the crusher have apertures formed in them, so that when the lid is engaged with the receptacle, a passageway for crushed cans is established by the apertures through the lid into the receptacle.

An elongated hollow housing having a first end and a second end is attached to the top of the lid. The first end of the housing is covered, and the second end of the housing is open. Also, one of the elongated sides of the housing is open. The elongated surface of the housing that is opposite to the open side of the housing is juxtaposed with the lid.

When the lid is engaged with an upright receptacle, the surface of the housing that is juxtaposed with the lid is the bottom surface of the housing. Accordingly, the open side of the housing is the top of the housing. The bottom surface has an opening formed in it near the first, i.e., closed, end of the housing, and the housing is positioned on the lid such that the opening in the bottom surface is directly above the aperture of the lid.

The housing forms a channel, and a plunger, such as a crushing plate which has approximately the same cross-section as the channel, is slidably disposed in the channel for reciprocating movement therein. A rod is pivotally attached to the crushing plate on the side of the crushing plate that faces the second, i.e., open, end of the housing. Also, the rod is pivotally attached to an elongated lever arm intermediate the ends of the lever arm, and one end of the lever arm is in turn pivotally attached to the housing adjacent the second, i.e., open end of the housing.

A handle is positioned on the end of the lever arm that is opposite to the end attached to the housing. The handle can be grasped to move the lever arm and in turn move the crushing plate between a crush position, wherein the plate is adjacent the closed end of the housing, and a receive position, wherein the plate is near the open end of the housing.

A stabilizer is fixedly attached to the crushing plate on the side of the plate that faces the first, i.e., closed, end of the housing. Desirably, this stabilizer is a cylindrical bar. One end of the bar is adjacent the edge of the plate that is juxtaposed with the open side, i.e., the top, of the housing, and the bar extends toward the bottom surface of the housing part way across the crushing plate.

In its operation, the lid is engaged with a suitable receptacle and the plate is moved to the receive position. When the plate is in the receive position, an empty aluminum can may be positioned through the open side of the housing and laid on its side within the housing with one end of the can positioned against the closed end of the housing. The lever arm is then moved to move the crushing plate against the can and axially compress the can against the closed end of the housing. As the crushing plate contacts the can, but before the can has been crushed, the stabilizing bar crimps the can to prevent the can from popping out of the open side of the housing. Importantly, this bar also operates as a pre-creaser which causes the top of the can to buckle about the bar significantly weakening the structural strength of the can, thereby allowing the can to be crushed with less effort by the user.

The crushing plate is advanced further against the can to crush the can. When the can has been sufficiently axially crushed so that the cross-section of the can is smaller than the hole in the housing, the can drops into the receptacle through the passageway formed by the hole of the housing and the aperture of the lid.

It is to be appreciated that the invention described above provides a can crusher which is portable and easily relocatable to a convenient site for crushing cans. In other words, the can crusher can be mounted on a receptacle in a common snack area, and can be easily relocated to another location, such as an outdoor picnic area, when desired. Further, it is to be appreciated that the present invention provides a can crusher which does not require the manual extraction of the crushed cans from the housing, thereby minimizing mess and the risk of a person cutting themselves on a crushed can. Additionally, the can crusher of the present invention does not require wall mounting, and thus does not result in the scarring of walls.

Advantageously, the can crusher is provided with fasteners for quickly and easily securing the lid of the can crusher to a storage receptacle. Together the can crusher and the receptacle form a can crushing and storage unit. Desirably, however, the can crusher is sized and shaped to be secured to a standard sized trash receptacle, e.g., a thirty-two gallon waste container so that the can crusher can be transported independently of the larger receptacle.

The details of the structure and the operation of the present invention can best be understood in reference to the accompanying drawings, in which like numerals refer to like parts, and in which:

BRIEF DESCRIPTION OF THE DRAWINGS

FIG. 1 is a perspective view of novel can crusher of the present invention, looking downwardly, showing the crushing plate in the receive position, with portions of the receptacle broken away for clarity; and FIG. 2 is a perspective view of novel can crusher of the present invention shown in FIG. 2, looking downwardly, showing the crushing plate in the crush position, with portions broken away and portions shown in phantom for clarity to show the crushed can dropping through the lid.

DESCRIPTION OF THE PREFERRED EMBODIMENT

Referring initially to FIG. 1, a can crusher is shown, generally designated 10. As shown, the can crusher 10 includes a lid 12 that can be removably engaged with a receptacle 14. The receptacle 14 can be any suitable container, and the lid 12 is configured as appropriate for removably engaging the receptacle 14. Preferably, however, as shown in FIG. 1, the receptacle 14 is a standard-sized frusto-conical thirty two (32) gallon plastic garbage can, and the lid 12 accordingly has a flat, disc-shaped configuration.

It can accordingly be appreciated that because of their frusto-conical shape, a plurality of receptacles 14 can be stored by a retail outlet in a compact nested configuration separately from their respective lids 12. The lids 12 can stored in a compact stacked configuration nearby the receptacles 14.

In the preferred embodiment, the lid 12 is held onto a lip 16 of the receptacle 14 by at least one, and preferably three, clips 15 (only clips 15*a*, b shown in FIG. 1). Each clip 15*a*, 15*b* snaps onto the lip 16 and lid 12 to fasten the lid 12 to the receptacle 14. Alternatively, the lid 12 can engage the lip 16 in an interference fit. Desirably, the lid is manufactured from steel sheet metal, so as to be durable and able to withstand the stress exerted on the lid by the crushing process. A pair of raised concentric annular rings 19 provide added rigidity to the lid. FIG. 1 also shows that if desired, a disposable liner 17 can be disposed within the receptacle 14 for holding crushed cans therein. Desirably, the liner 17 is a standard three-ply plastic garbage can liner. Importantly, by using such a liner, multiple bags of crushed cans can be collected and stored by simply removing the filled liner from the receptacle 14 and replacing it with an empty liner. In this manner, thousands of cans can be collected before the cans need to be transported and the consumer need never touch a crushed can and thereby risk injury.

FIG. 1 also shows that the can crusher 10 includes a housing 18. The housing 18 can have any shape suitable for holding a can to be crushed, and desirably, is an elongated, parallelepiped-shaped housing. Alternatively, the housing 18 can be shaped as a hollow cylinder.

As further shown in FIG. 1, a pivot end 20 of a lever arm 22 is pivotally connected to a first end 24 of the housing 18. Additionally, a handle 26 suitable for grasping by the human hand is fixedly attached to the free end 28 of the lever arm 22. As shown, the pivot end 20 is positioned near the edge of the lid 12, to enhance the stability of the receptacle 14 when the lever arm 22 is operated as more fully disclosed below.

As shown in FIG. 1, the housing 18 forms a channel 30 which extends the length of the housing 18. The channel 30 is configured to permit a standard-sized twelve-ounce (12 oz.) aluminum can to be positioned within the channel 30 substantially coaxially with the channel 30 so that the longitudinal axis of the can is substantially horizontal. It is to be understood that the size of the channel 30 can be established for receiving aluminum cans which are larger or smaller than a 12 oz. can.

Also, FIG. 1 shows that the first end 24 of the housing 18 is open, and that a second end 32 of the housing 18 is closed, although the first end 24 may alternatively be closed without affecting the operation of the can crusher 10. Likewise, the second end need not be fully closed, although this is desirable to prevent spills, but rather need only form a suitable surface or anvil against which a can may be driven and crushed. It will be appreciated by the skilled artisan that by making the first end 24 open, the can crusher 10 can be made with less material and hence, more economically. Additionally, FIG. 1 shows that the housing 18 has a closed surface 34 which is juxtaposed with the lid 12, and an open side 36 opposite the closed surface 34. When the receptacle 14, shown in FIG. 1, is upright, the lid 12 is on top of the receptacle 14. Accordingly, the closed surface 34 can be referred to as the bottom surface of the housing 18.

A first retaining lip 38*a* is formed on one side of the channel 30 near the open side 36 of the housing 18, and a second retaining lip 38*b* is formed on the opposite side of the channel 30 from the first retaining lip 38*a*. Additionally, an opening 40 is formed in the closed surface 34 of the housing 18, and an aperture 42 is formed in the lid 12. As shown in FIG. 1, the aperture 42 and opening 40 are juxtaposed, so that when the receptacle 14 is upright, a suitably configured object can drop through the passageway established by the opening 40 and aperture 42 into the receptacle 14.

FIG. 1 further shows that the can crusher 10 includes a suitably configured plunger reciprocally disposed in the channel 30 for urging against a can 44 (shown in FIG. 2) to be crushed. In one presently preferred embodiment, this plunger is a crushing plate 46 which is reciprocally disposed in the channel 30. As intended by the present invention, the crushing plate 46 is movable between a receive position, shown in FIG. 2, wherein the plate 46 is distanced from the closed end 24 of the housing 18, and a crush position, shown in FIG. 3, wherein the plate 46 is advanced toward the closed end 24, desirably beyond the end of the opening 46 (and aperture 42) nearest the first end 24 of the housing.

It may now be understood that the retaining lips 38*a*, 38*b* cooperate to retain the plate 46 within the channel 30 when the plate 46 is reciprocated therein. It is to be further understood that the shape of the plate 46 can be any suitable shape, and need not be flat. Preferably, however, the plate 46 is flat and conforms to the cross-sectional shape of the channel 30. Thus, when the housing 18 is generally parallelepiped-shaped, as shown, the edges of the plate 46 which are adjacent the sides of the housing 18 are straight.

Still referring to FIG. 1, a member for stabilizing the can within the channel 30 during the crushing process is shown. Specifically, a solid cylindrical bar 48 is fixedly attached, e.g., by welding, to the plate 42 facing the closed end 24 of the housing 18, and this bar 48 pre-creases the can to be crushed as further described below to prevent the can to be crushed from popping out of the housing 18. It would also be possible to secure a pre-creasing bar to the closed end of the housing and use a flat plunger to force the can against the pre-crease bar.

As shown, a first end 50 of the bar 48 is adjacent the open side 36 of the housing 18, and a second end 52 is positioned near the bottom surface 34 of the housing 18. An end 54 of the can 44 (shown in FIG. 2) is accordingly contacted and pre-creased by the bar 48 as the plate 46 is advanced into the can 44. Consequently, as the plate 46 is further advanced into the can 44 to crush the can 44, the pre-creasing of the can 44 tends to cause the can 44 to collapse relatively symmetrically within the housing 18. This substantially prevents the can 44 from popping out of the housing 18 during the crushing process.

FIG. 1 also shows that an elongated solid or hollow rod 56 is pivotally connected to the plate 46. To connect the rod 56 to the plate 46, a bracket 58 is mounted on the plate 46, and a pivot shaft 62 extends through the bracket 58 and the rod 56 to pivotally connect the rod 56 to the bracket 58.

In the preferred embodiment, the bracket 56 is established by portions 60*a*, 60*b* of the plate 46, which are preferably bent during the manufacturing process at a normal angle relative to the plate 46. If desired, however, the bracket 58 can be made separately from the plate 46 and then welded or bolted to the plate 46 during manufacture of the can crusher 10. The ends of the pivot shaft 62 are connected to respective flanges (only flange 64 shown in FIG. 1) which are in turn attached to or formed integrally with the plate 46.

Continuing with the description of structure shown in FIG. 1, the rod 56 has an end 70, and this end 70 is pivotally attached to the elongated lever arm 22 intermediate the pivot end 20 and the free end 28 of the lever arm 22. Specifically, a lever arm bracket 68 is attached to the lever arm 22, and the end 66 of the rod 56 is pivotally held between the arms of the bracket 68 by a pin 70 which extends through the bracket 68 and the rod 56. As recognized by the present invention, the lever arm bracket 68 can advantageously be welded to the lever arm 22.

FIGS. 1 and 2 show that in one embodiment of the can crusher 10, the handle 26 can advantageously be established by two extensions 72, 74 of the lever arm 22 and a wooden grip 76 that extends between the extensions 72, 74.

In the operation of the can crusher 10, the lid 12 is engaged with the receptacle 14, and the crushing plate 46 is moved to the receive position, shown in FIG. 1, by grasping the handle 26 and appropriately urging the free end 28 of the lever arm 22 away from the lid 12. In this configuration, an empty can to be crushed can be positioned through the open side 36 of the housing 18, with one end of the can abutting the closed end 24 of the housing 18. Then, the handle 26 is grasped and the free end 28 pivoted toward the lid 12, i.e., toward the position shown in FIG. 2, to move the plate 46 against the can.

As the bar 48 contacts the can 44, the bar 48 crimps the can 44 to cause the can 44 to tend to collapse relatively symmetrically about a radial axis. Since the force exerted by the plunger is concentrated on the smaller surface area of the bar 48, a greater force per unit area can be created to break the lip of the can. Importantly, it has been found that this precreasing of the upper lip or lower lip significantly diminishes the structural integrity of the can, making it easier to crush. The plate 46 is advanced further against the can to axially compress, i.e., crush, the can between the plate 46 and the closed end 24 of the housing 18.

When the can 44 (shown in FIG. 2) has been crushed to the extent that the axial length 1 of the can 44 is less than the width W of the opening 40 (and aperture 42), the can 44 drops into the receptacle 18, as shown in FIG. 2. Desirably, the opening 40 and aperture 42 have a width W of $1\frac{5}{8}$ inches and are generally vertically aligned with the center of gravity of the unit. This has been found to increase the stability of the unit. When the can crusher 10 is in the configuration shown in FIG. 2, the lever arm 22 covers the plate 46 and thereby establishes a safety cover to prevent people from cutting themselves on the plate 46.

While the particular embodiment of the can crusher as herein shown and described in detail is fully capable of attaining the objects hereinbefore stated, it is to be understood that no limitations are to be imposed on the scope of the present invention, other than the limitations defined by the appended claims.

I claim:

1. A can crushing and storage unit, comprising:

a can crusher, including a housing having an open side and forming a channel for receiving the can therein, said housing having a first end and a second end, said housing defining an opening formed near said second end, said channel defining a space sized and shaped to receive a standard sized aluminum can having a longitudinal axis so that said longitudinal axis of said can is substantially horizontal and perpendicular to said ends of said housing, said can crusher further comprising a plate reciprocally disposed within said channel for urging said can against said second end of said housing and a rod pivotally connected to said plate and an elongated lever arm having a pair of ends, said lever arm pivotally connected to said rod between said pair of ends of said lever arm, said lever arm also being pivotally connected to said housing for moving said plate toward said second end of said housing to compress said can;

a lid upon which said can crusher is mounted, said lid having a passage therethrough juxtaposed with said opening in said housing; and a receptacle to which said lid is secured, wherein said crusher crushes a can positioned within said space until it is sufficiently axially compacted that gravity causes it to fall through said opening in said housing and through said passage in said lid and into the receptacle, wherein said opening and said passage are generally vertically aligned with the center of gravity of said unit.

2. A can crusher, comprising:

a lid engageable with a receptacle, said lid having an aperture;

a housing having a first end and a second end, said housing defining an opening formed near said second end, said housing being positioned with said opening juxtaposed with said aperture, said housing forming a channel;

a plunger reciprocally disposed in said channel for movement between a crush position, wherein said plunger is adjacent said second end, and a receive position, wherein said plunger is distanced from said second end;

a lever arm connected to said plunger for moving said plunger in said channel; and, a stabilizer attached to said plunger and facing said second end of said housing for crimping a can to be crushed, wherein said channel has a vertical cross section and said plunger includes a flat plate having a vertical cross-section generally conforming in shape to said vertical cross section of said channel, wherein said lever arm has a pair of ends and said lever arm includes a rod pivotally connected to said plunger and an elongated arm pivotally connected to said rod between said pair of ends of said arm, said arm also being connected to said housing and wherein said stabilizer is a cylindrical bar and said housing has an open side opposite said lid, said bar having a first end positioned adjacent said open side and a second end distanced from said open side relative to said first end of said bar.

3. A device for compressing an aluminum can, which comprises:

a housing having an open side and forming a channel for receiving the can therein, said housing having a first end and a second end, said housing defining an opening formed near said second end;

crushing means reciprocally disposed within said channel for urging the can against said second end of said housing;

means for moving said crushing means toward said second end to compress the can; and stabilizing means operatively engaged with said crushing means for substantially preventing the can from passing through said open side of said housing during compression of the can, further comprising a lid attached to said housing, said lid having an aperture juxtaposed with said opening of said housing, wherein said stabilizing means is attached to said crushing means facing said second end of said housing for engaging the can to be crushed and holding the can substantially within said channel during the crushing process, wherein said crushing means is a plate having approximately the same radial shape as said channel, wherein said moving means includes a rod pivotally connected to said plate and an elongated lever arm having a pair of ends, said lever arm pivotally connected to said rod between said pair of ends of said lever arm, said lever arm also being pivotally connected to said housing, and wherein said stabilizing means is a cylindrical bar and said housing is positioned on said lid with said open side opposite said lid, said bar having a first end positioned adjacent said open side and a second end distanced from said open side relative to said first end of said bar.

4. The can crusher of claim 3, wherein said lever arm has a pivot end connected to said housing and grasping end, and said lever arm further comprises a handle attached to said grasping end.

5. The can crusher of claim 4, further comprising a receptacle engageable with said lid to hold crushed cans.

* * * * *